US009078533B2

(12) United States Patent
Hession

(10) Patent No.: US 9,078,533 B2
(45) Date of Patent: Jul. 14, 2015

(54) DISPLAY TRAY FOR DISPLAYING A PLURALITY OF CONTAINERS

(71) Applicant: Altria Client Services Inc., Richmond, VA (US)

(72) Inventor: Christopher J. Hession, Richmond, VA (US)

(73) Assignee: ALTRIA CLIENT SERVICES, INC., Richmond, VA (US)

( * ) Notice: Subject to any disclaimer, the term of this patent is extended or adjusted under 35 U.S.C. 154(b) by 0 days.

(21) Appl. No.: 14/528,972

(22) Filed: Oct. 30, 2014

(65) Prior Publication Data

US 2015/0122694 A1 May 7, 2015

Related U.S. Application Data

(60) Provisional application No. 61/899,059, filed on Nov. 1, 2013.

(51) Int. Cl.
*B65D 6/04* (2006.01)
*A47F 5/11* (2006.01)

(52) U.S. Cl.
CPC ..... *A47F 5/11* (2013.01)

(58) Field of Classification Search
USPC ..... 206/562, 563, 564, 745, 746, 747, 748, 206/749, 750, 736, 521, 784; 220/507
See application file for complete search history.

(56) References Cited

U.S. PATENT DOCUMENTS 1,367,600 A 2/1921 J. Hirsch
1,985,670 A * 12/1934 Sykes ..... 217/26
2,459,921 A * 1/1949 Comer ..... 220/512
2,813,621 A 11/1957 G. S. Parker, II
2,833,457 A 5/1958 W. J. Tyrseck
3,002,722 A * 10/1961 Cote ..... 248/174
3,397,771 A * 8/1968 Fogle ..... 206/750
3,437,193 A * 4/1969 Freeman ..... 206/780
3,565,323 A * 2/1971 Katzenmeyer ..... 229/117.14
3,670,872 A * 6/1972 Rock et al. ..... 206/745
3,682,597 A 8/1972 R, L. Husch
3,942,631 A * 3/1976 Sutherland et al. ..... 206/738

(Continued)

OTHER PUBLICATIONS

International Search Report of PCT/US2014/063227 dated Mar. 26, 2015.

(Continued)

*Primary Examiner* — Jacob K Ackun

(74) *Attorney, Agent, or Firm* — Roberts Mlotkowski Safran & Cole, P.C.

(57) ABSTRACT

A display tray for displaying a plurality of containers. The display includes a base having a first longitudinal edge, and a second longitudinal edge; a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section.

23 Claims, 5 Drawing Sheets

(56) References Cited

U.S. PATENT DOCUMENTS 4,053,099 A * 10/1977 Lock ..... 206/562
7,735,649 B2 * 6/2010 Kim-Gifford et al. ..... 206/485

OTHER PUBLICATIONS

Written Opinion of the International Searching Authority of PCT/US2014/063227 dated Mar. 26, 2015.

* cited by examiner

DISPLAY TRAY FOR DISPLAYING A PLURALITY OF CONTAINERS

RELATED APPLICATION

This application claims the benefit of U.S. Provisional Application Ser. No. 61/899,059, filed on Nov. 1, 2013, the contents of which are hereby incorporated by reference in their entirety.

FIELD

This document relates generally to packaging for use with a plurality of containers and, more particularly, to packaging for use in the point-of-sale (POS) display of consumer products, such as various forms of smokeless tobacco products.

Environment

Recently, new forms of smokeless tobacco products have entered the market place or have been described, including tobacco products in the form of gels, films, gum and tablets. Designing packaging for use with a smokeless tobacco product provides unique challenges. For example, with tobacco-based products, moisture content can become an issue, since tobacco is, by its nature, hygroscopic.

In the packaging of tobacco tablets and tobacco gum for distribution to consumers, blister packs are frequently utilized. Larger format tobacco tablets and tobacco gum may be packaged in tubular containers, as often found in pharmaceutical and medical products. A stack of large format tablets tend to survive the rigors of shipping, since the tobacco tablets are not free to randomly collide with one another through product jostling during transit and tobacco gum tends to have the necessary resiliency to avoid breakage during transit.

A wide variety of commercial packaging is available for use in point-of-sale applications. However, not all are suitable for use with smokeless tobacco products, due to the physical and intrinsic characteristics of the products themselves, and the particular requirements associated with the marketing of tobacco products.

As such, there remains a need for improved display cartons and systems for use with smokeless tobacco products, including tobacco gum and large format tobacco tablets that are packaged and sold in containers and for methods of making such packaging and displaying such products.

SUMMARY

Disclosed herein are display cartons for use with a plurality of containers, point-of-sale systems employing same and methods for making display cartons and systems.

In one aspect, provided is a display tray for displaying a plurality of containers. The display includes a base having a first longitudinal edge, and a second longitudinal edge; a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section and having a plurality of openings positioned along an apex thereof.

In some forms, the first tray member further comprises a third side extending from the lower edge of the second side and terminating at a downstream edge adjacent the first longitudinal edge of the base, wherein the edge formed by the second and third sides includes at least one locking tab extending therefrom.

In some forms, the second tray member further comprises a third side extending from the lower edge of the second side and terminating at a downstream edge adjacent the second longitudinal edge of the base, wherein the edge formed by the second and third sides includes at least one locking tab extending therefrom.

In some forms, the base further comprises a plurality of tab-receiving openings for receiving the at least one locking tab of the first tray member and the at least one locking tab of the second tray member.

In some forms, the base is rectangular.

In some forms, the apex of the first tray member and the apex of the second tray members are aligned in parallel.

In some forms, the plurality of openings of the first tray member and the plurality of openings of the second tray member are substantially circular.

In some forms, the downstream edge of the third side of the first tray member and the downstream edge of the third side of the second tray member each include a plurality of biasing scallops, the biasing scallops effective to bias the at least one locking tab of the first tray member and the at least one locking tab of the second tray member into locking engagement with the base.

In some forms, the display tray is formed from a sheet of cardboard stock.

In some forms, the display tray is formed from a sheet of substantially clear polyethylene terephthalate stock.

In another aspect, provided is a system for displaying a plurality of containers at a point of sale. The system includes: display tray for displaying a plurality of containers, the display tray comprising i) a base having a first longitudinal edge, and a second longitudinal edge; ii) a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and iii) a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section and having a plurality of openings positioned along an apex thereof; a rectangular carton for receiving the display tray; and a plurality of containers for receiving product, the plurality of containers configured for receipt by the plurality of openings of the first and second tray members of the display tray.

In some forms, the first tray member further comprises a third side extending from the lower edge of the second side and terminating at a downstream edge adjacent the first longitudinal edge of the base, wherein the edge formed by the second and third sides includes at least one locking tab extending therefrom.

In some forms, the second tray member further comprises a third side extending from the lower edge of the second side and terminating at a downstream edge adjacent the second longitudinal edge of the base, wherein the edge formed by the second and third sides includes at least one locking tab extending therefrom.

In some forms, the base further comprises a plurality of tab-receiving openings for receiving the at least one locking tab of the first tray member and the at least one locking tab of the second tray member.

In some forms, the base is rectangular.

In some forms, the apex of the first tray member and the apex of the second tray members are aligned in parallel.

In some forms, the plurality of openings of the first tray member and the plurality of openings of the second tray member are substantially circular.

In some forms, the downstream edge of the third side of the first tray member and the downstream edge of the third side of the second tray member each include a plurality of biasing scallops, the biasing scallops effective to bias the at least one locking tab of the first tray member and the at least one locking tab of the second tray member into locking engagement with the base.

In some forms, the display tray is formed from a sheet of cardboard stock.

In some forms, the display tray is formed from a sheet of substantially clear polyethylene terephthalate stock.

In yet another aspect, provided is a method of forming a display tray for displaying a plurality of containers from a sheet of stock. The method includes the steps of: cutting the sheet of stock into a size and shape sufficient to form a substrate having a plurality of panels, the substrate having a first surface and a second surface and a first edge and a second edge, the first edge and the second edge of the substrate provided with a plurality of biasing scallops; forming a plurality of openings lengthwise along the penultimate outer panels of the plurality of panels of the substrate; forming a plurality of tab-receiving openings through the center panel of the plurality of panels of the substrate; folding the outermost panels over to face the second surface of the substrate, each fold line of the outermost panels having at least one locking tab extending therefrom; folding each of the penultimate outer panels of the plurality of panels of the substrate substantially along a longitudinal centerline thereof, so that the second surface of each portion of each penultimate outer panel faces the other; positioning each outermost panel so that the plurality of biasing scallops of the first edge and the second edge extend through their respective adjacent plurality of openings; positioning the at least one locking tab of each fold line of the outermost panels through the plurality of tab-receiving openings of the center panel; and positioning each of the outermost panels so as to contact the center panel; wherein each of the plurality of biasing scallops contact a fold line formed by the center panel and each of the each penultimate outer panels so as to bias and lock each of the at least one locking tabs within its respective tab-receiving opening.

In one form, the formed display tray includes a base having a first longitudinal edge, and a second longitudinal edge; a first tray member comprising a first side extending from the first longitudinal edge of the base and terminating at an upper edge thereof, a second side extending from the upper edge of the first side and terminating at a lower edge thereof adjacent the base; a third side extending from the lower edge of the second side and terminating at a downstream edge adjacent the first longitudinal edge of the base, wherein the edge formed by the second and third sides includes at least one locking tab extending therefrom, the first tray member forming a substantially triangular cross-section and having a plurality of openings positioned along an apex thereof; a second tray member comprising a first side extending from the second longitudinal edge of the base and terminating at an upper edge thereof, a second side extending from the upper edge of the first side and terminating at a lower edge thereof adjacent the base; a third side extending from the lower edge of the second side and terminating at a downstream edge adjacent the second longitudinal edge of the base, wherein the edge formed by the second and third sides includes at least one locking tab extending therefrom, the second tray member forming a substantially triangular cross-section and having a plurality of openings positioned along an apex thereof, wherein the base further comprises a plurality of tab-receiving openings for receiving the at least one locking tab of the first tray member and the at least one locking tab of the second tray member, wherein the downstream edge of the third side of the first tray member and the downstream edge of the third side of the second tray member each include a plurality of biasing scallops.

In yet another aspect, provided is a method of presenting containers of product for sale to a consumer. The method includes the steps of arranging the containers in a display tray and protecting the containers with a carton for receiving the tray, the carton having a portion thereof structured and arranged to form a display panel, the display tray comprising a base having a first longitudinal edge, and a second longitudinal edge; a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section and having a plurality of openings positioned along an apex thereof; configuring the portion of the carton so as to present a display panel while revealing the containers to the consumer.

These and other features will be apparent from the detailed description taken with reference to the accompanying drawings.

BRIEF DESCRIPTION OF THE DRAWINGS

Further explanation may be achieved by reference to the description that follows and the drawings illustrating, by way of non-limiting examples, various forms, wherein.

DETAILED DESCRIPTION

Various aspects will now be described with reference to specific forms selected for purposes of illustration. It will be appreciated that the spirit and scope of the packages and methods disclosed herein are not limited to the selected forms. Moreover, it is to be noted that the figures provided herein are not drawn to any particular proportion or scale, and that many variations can be made to the illustrated forms. Reference is now made to FIGS. 1-7, wherein like numerals are used to designate like elements throughout.

Figure 1:
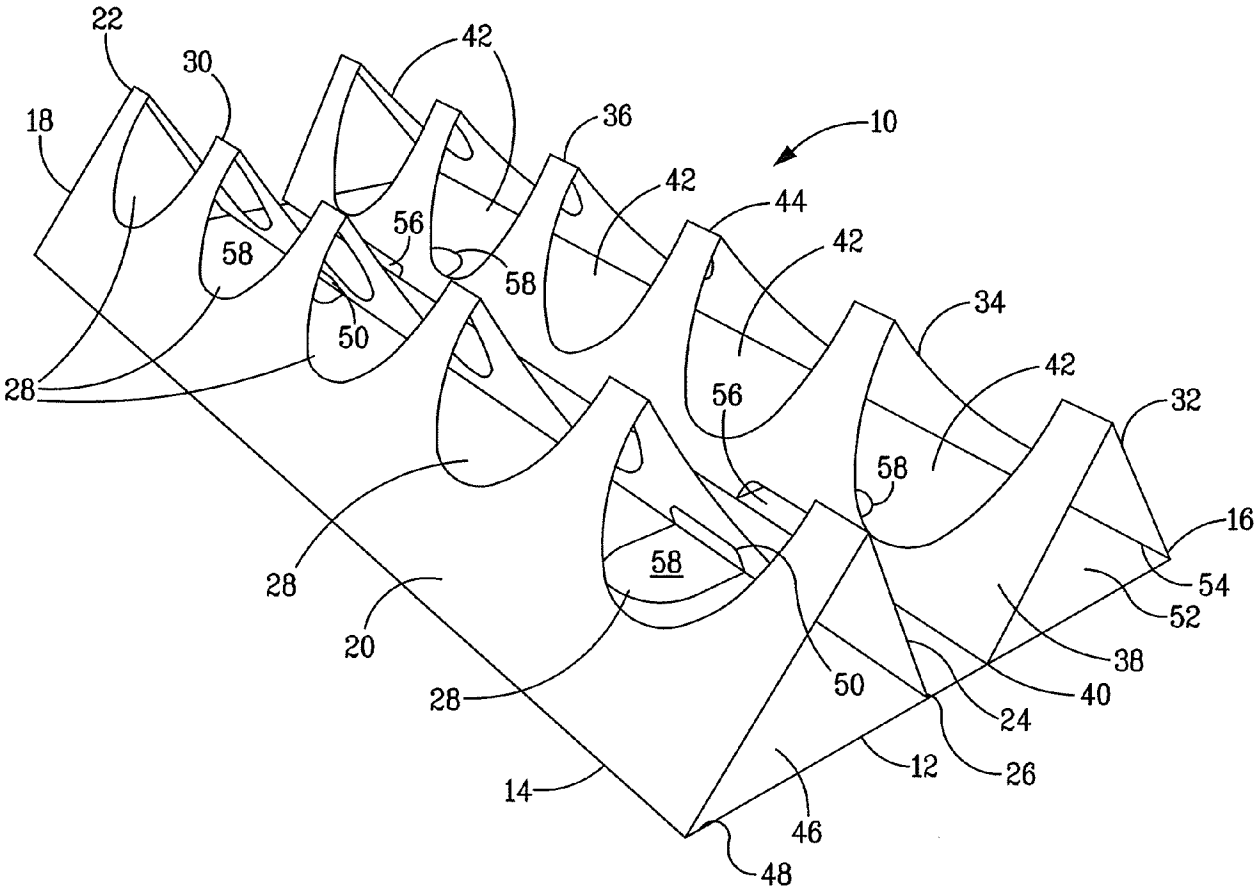
FIG. 1 is a perspective view of a display tray, in accordance herewith.

Referring to FIG. 1, one form of a display tray 10 for displaying a plurality of containers is shown. The display tray 10 includes a base 12 having a first longitudinal edge 14, and a second longitudinal edge 16.

The display tray 10 also includes a first tray member 18. The first tray member 18 includes a first side 20 extending from the first longitudinal edge 14 of the base 12 and terminating at an upper edge 22. The first tray member 18 also includes a second side 24 extending from the upper edge 22 of the first side 20 and terminating at a lower edge 26 adjacent the base 12. As shown in FIG. 1, the first tray member 18 forms a substantially triangular cross-section. To facilitate the positioning of a plurality of containers, the first tray member 18 is provided with a plurality of openings 28 positioned along apex 30.

In some forms, where it is desired to display a dual row of containers, the display tray 10 may be provided with a second tray member 32. The second tray member 32 includes a first side 34 extending from the second longitudinal edge 16 of the base 12 and terminating at an upper edge 36. The second tray member 32 also includes a second side 38 extending from the upper edge 36 of the first side 34 and terminating at a lower edge 40 adjacent the base 12. As shown in FIG. 1, the second tray member 32 forms a substantially triangular cross-section. As is the case with the first tray member 18, the second tray member 32 is provided with a plurality of openings 42 positioned along an apex 44.

In some forms, where improved rigidity is desired, the first tray member 18 is provided with a third side 46 extending from the lower edge 26 of the second side 24 and terminating at a downstream edge 48 adjacent the first longitudinal edge 14 of the base 12. Adjacent the edge 26 formed by the second and third sides, 24 and 46, respectively; at least one locking tab 50 is provided and extends therefrom.

Likewise, as in the case of the first tray member 18, the second tray member 32 may be provided with a third side 52 extending from the lower edge 40 of the second side 38 and terminating at a downstream edge 54 adjacent the second longitudinal edge 16 of the base 12. Adjacent the edge 40 formed by the second and third sides, 38 and 52, respectively; at least one locking tab 56 is provided and extends therefrom.

In some forms, the base 12 is provided with a plurality of tab-receiving openings 58 for receiving the at least one locking tab 50 of the first tray member 18 and the at least one locking tab 56 of the second tray member 32.

As shown in FIG. 1, in some forms, the base 12 of the display tray 10 is rectangular, although other shapes are contemplated and within the scope of the present disclosure. Moreover, in some forms, the apex 30 of the first tray member 18 and the apex 44 of the second tray member 32 are aligned in parallel.

Figure 2:
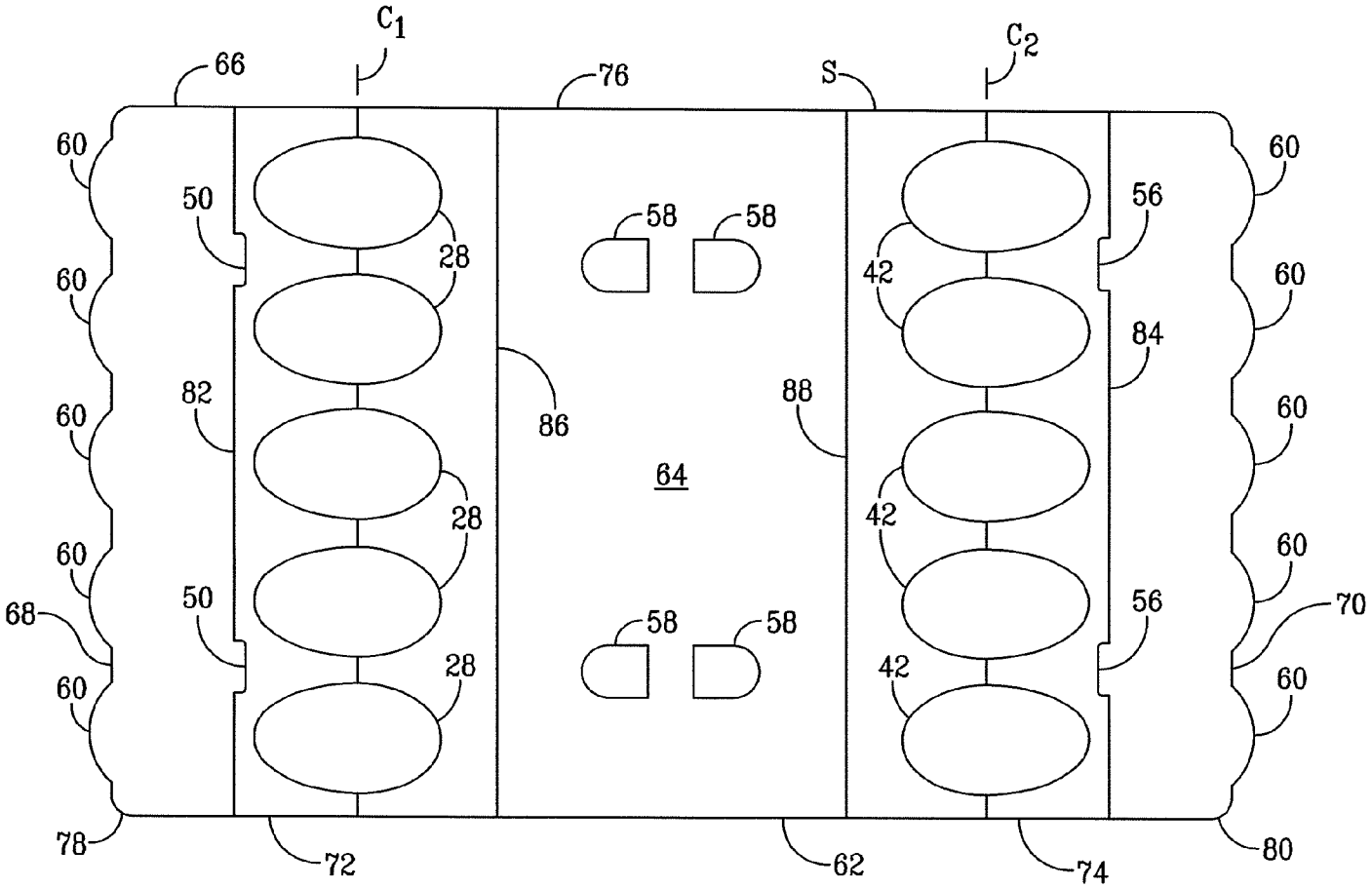
FIG. 2 depicts a lay flat view of a substrate for use in forming a display tray, in accordance herewith.

Referring to FIG. 2, although egg-shaped when cut in the layflat position, when configured as shown in FIG. 1, the plurality of openings 28 of the first tray member 18 and the plurality of openings 42 of the second tray member 32 are substantially circular.

Referring again to FIG. 2, the downstream edge 48 of the third side 46 of the first tray member 18 and the downstream edge 54 of the third side 52 of the second tray member 32 each include a plurality of biasing scallops 60, the biasing scallops 60 effective to bias the at least one locking tab 50 of the first tray member 18 and the at least one locking tab 56 of the second tray member 32 into locking engagement with the base 12.

Referring still to FIG. 2, method of forming a display tray for displaying a plurality of containers from a sheet of stock S will be described. Initially, the sheet of stock S cut into a size and shape sufficient to form a substrate 62 having a plurality of panels, the substrate 62 having a first surface 64 and a second surface 66 and a first edge 68 and a second edge 70, the first edge 68 and the second edge 70 of the substrate 62 provided with a plurality of biasing scallops 60.

Also, a plurality of openings 28 is formed lengthwise along the first penultimate outer panel 72 of the substrate 62 and a plurality of openings 42 is formed lengthwise along the second penultimate outer panel 74 of the substrate 62. In some forms, a plurality of tab-receiving openings 58 is formed through the center panel 76 of the substrate 62. As may be appreciated by those skilled in the art, substrate 62 and openings 28, 42, and 58 may be formed in one operation.

The assembly of display tray 10 will now be described. Note that, while a particular order of folding the panels is described, assembly tray 10 may be folded from substrate 62 in one or more different manners while still achieving a display tray as shown and generally described.

In some forms, the first outermost panel 78 and the second outermost panel 80 are folded over to face the second surface 66 of the substrate 62. As shown, fold line 82 of the first outermost panel 78 has at least one locking tab 50 extending therefrom and fold line 84 of the second outermost panel 80 has at least one locking tab 56 extending therefrom.

In some forms, first penultimate outer panel 72 of the substrate 62 is folded substantially along a longitudinal centerline $C_1$ so that the second surface 66 of each portion of first penultimate outer panel 72 faces the other. Likewise, in some forms, second penultimate outer panel 74 of the substrate 62 is folded substantially along a longitudinal centerline $C_2$ so that the second surface 66 of each portion of second penultimate outer panel 74 faces the other.

In some forms, the width of each outermost panel 78 and 80 exceeds the width of each portion of each penultimate outer panel 72 and 74 when folded along it respective centerline $C_1$ and $C_2$. Therefore, each outermost panel 72 and 74 may be positioned so that the plurality of biasing scallops 60 of the first edge 68 and the second edge 70 extend through their respective adjacent plurality of openings 28 and 42. At this point, the first tray member 18 and the second tray member 32 (see FIG. 1) begin to take form of substantially triangular cross-sectional structures.

Figure 7:
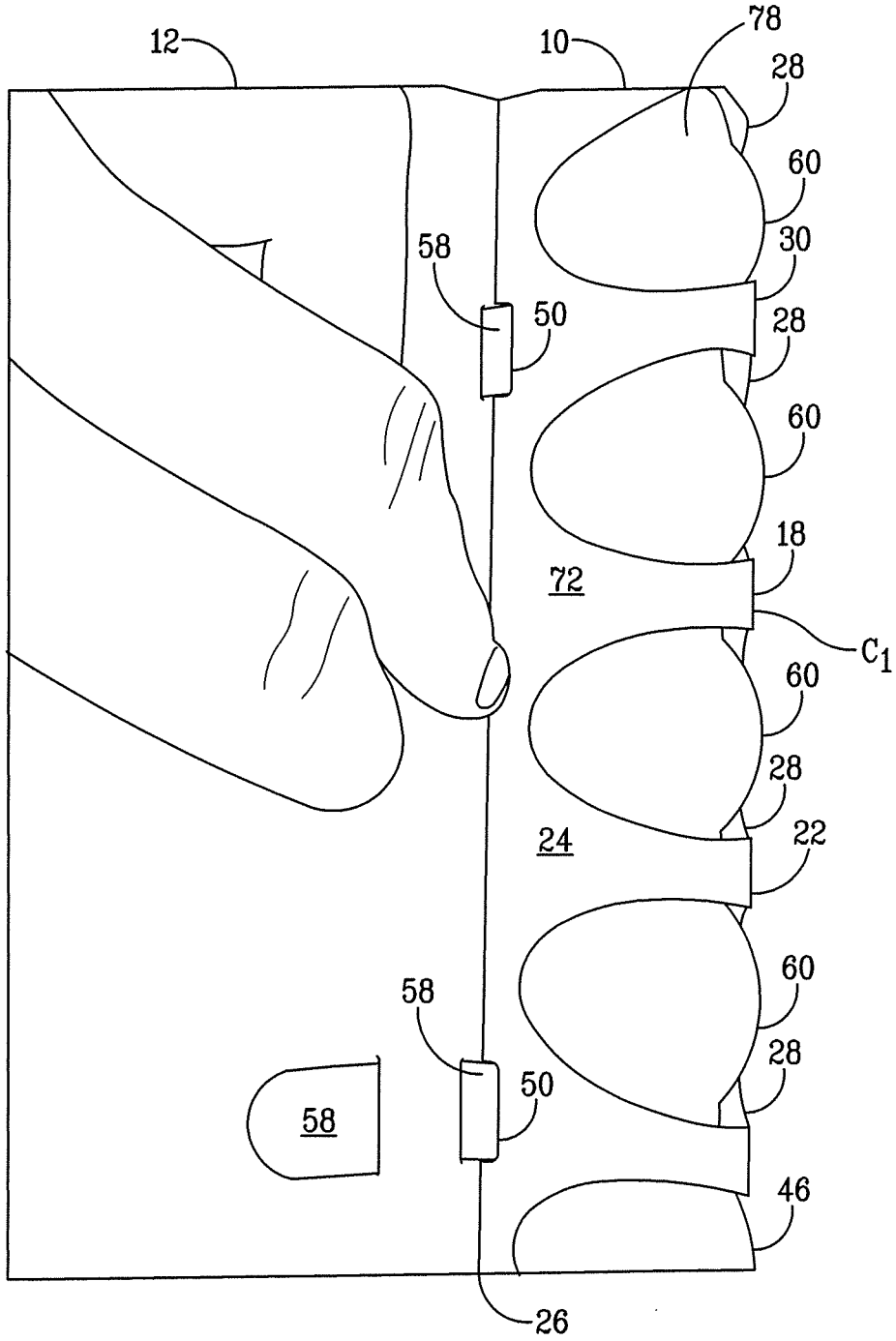
FIG. 7 presents a view of a partially assembled display tray, in accordance herewith.

Referring now to FIG. 7, a partial view of a partially assembled display tray 10 is depicted. As shown, the first tray member 18 is in the process of being assembled. Scallops 60 of the third side 46 extend through the plurality of openings 28, as previously described, due to the width of outermost panel 78 exceeding the width of each portion of each penultimate outer panel 72 and 74 when folded along it respective centerline $C_1$. Third side 46 is then urged downward to form the substantially triangular cross-sectional structure, as described hereinbelow in more detail, with the extra width of the third side 46 serving to bias and lock the at least one locking tabs 50 within its respective tab-receiving opening 58.

Referring again to FIG. 2, the at least one locking tab 50 of fold line 82 of outermost panel 78 is positioned and inserted through adjacent tab-receiving openings 58 of the center panel 76, from the second surface 66 side of substrate 62. Likewise, the at least one locking tab 56 of fold line 84 of outermost panel 80 is positioned and inserted through adjacent tab-receiving openings 58 of the center panel 76, from the second surface 66 side of substrate 62.

Next, each of the outermost panels 78 and 80 are positioned so as to contact the second surface 66 of center panel 62. In some forms, each of the plurality of biasing scallops 60 of first edge 68 contact a fold line 86 formed by the center panel 76 and the penultimate outer panel 72 so as to bias and lock each of the at least one locking tabs 50 within its respective tab-receiving opening 58. Likewise, in some forms, each of the plurality of biasing scallops 60 of second edge 70 contact a fold line 88 formed by the center panel 76 and the penultimate outer panel 74 so as to bias and lock each of the at least one locking tabs 56 within its respective tab-receiving opening 58.

Following the method described hereinabove results in the formation of display tray 10 of the type depicted in FIG. 1 In particular, in this form, display tray 10 includes a base 12 having a first longitudinal edge 14, and a second longitudinal edge 16. A first tray member 18 includes a first side 20 extending from the first longitudinal edge 14 of the base 12 and terminating at an upper edge 22, a second side 24 extending from the upper edge 22 of the first side 20 and terminating at a lower edge 26 adjacent the base 12; a third side 46 extending from the lower edge 26 of the second side 24 and terminating at a downstream edge 48 adjacent the first longitudinal edge 14 of the base 12. As described, the edge 26 formed by the second and third sides 24 and 46 includes at least one locking tab 50 extending therefrom. As shown, the first tray member 18 forms a substantially triangular cross-section, having a plurality of openings 28 positioned along an apex 30. Display tray 10 may also include a second tray member 32, which includes a first side 34 extending from the second longitudinal edge 16 of the base 12 and terminating at an upper edge 36, a second side 38 extending from the upper edge 36 of the first side 34 and terminating at a lower edge 40 adjacent the base 12, a third side 52 extending from the lower edge 40 of the second side 38 and terminating at a downstream edge 54 adjacent the second longitudinal edge 16 of the base 12. As described, the edge 40 formed by the second and third sides 38 and 52 includes at least one locking tab 56 extending therefrom. As shown, the second tray member 32 also forms a substantially triangular cross-section and has a plurality of openings 42 positioned along an apex 44. The base 12 also includes a plurality of tab-receiving openings 58 for receiving the at least one locking tab 50 of the first tray member 18 and the at least one locking tab 56 of the second tray member 32.

Display tray 10 may be produced from a wide variety of materials. In some forms, display tray 10 is formed from a sheet of cardboard stock. In some forms, display tray 10 is formed from a sheet of substantially clear polyethylene terephthalate (PET) stock. In some forms, display tray 10 is formed from a sheet of polyvinyl chloride (PVC).

Advantageously, when display tray 10 is produced from a substantially clear stock, such as PET, the plurality of containers can be presented in an array that enhances the ability to view a major portion of the container, and any information contained thereon, while supporting the containers in an upright position for customer inspection. The presentation of the plurality of containers in this pleasing, spaced-apart, manner increases the appeal of the product to the consumer, while maximizing viewing access.

Figure 3:
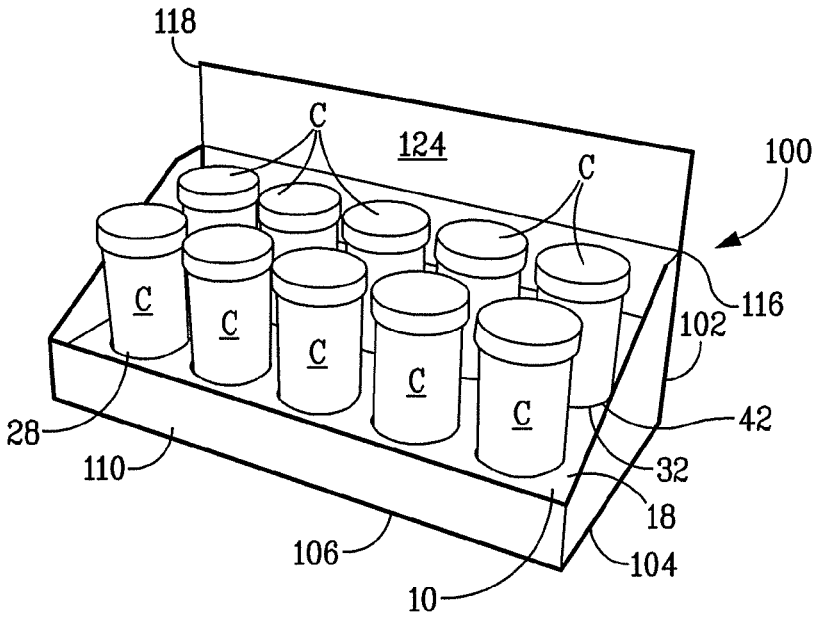
FIG. 3 is a perspective view of a system for displaying a plurality of containers at a point of sale, in accordance herewith.

Referring now to FIG. 3, a system for displaying a plurality of containers at a point of sale 100 is shown. System 100 includes a display tray (schematically depicted) for displaying a plurality of containers of the type described above with reference to FIGS. 1 and 2. System 100 also includes a rectangular display carton 102 for receiving the display tray 10.

System 100 is advantageously structured and arranged to receive and present a plurality of containers C containing the product being marketed. The plurality of containers C is configured to be received by the plurality of openings 28 and 42 of the first and second tray members 18 and 32 of the display tray 10.

Rectangular display carton 102 may be produced from a wide variety of materials. In some forms, rectangular display carton 102 is formed from a sheet of cardboard stock.

Figure 4:
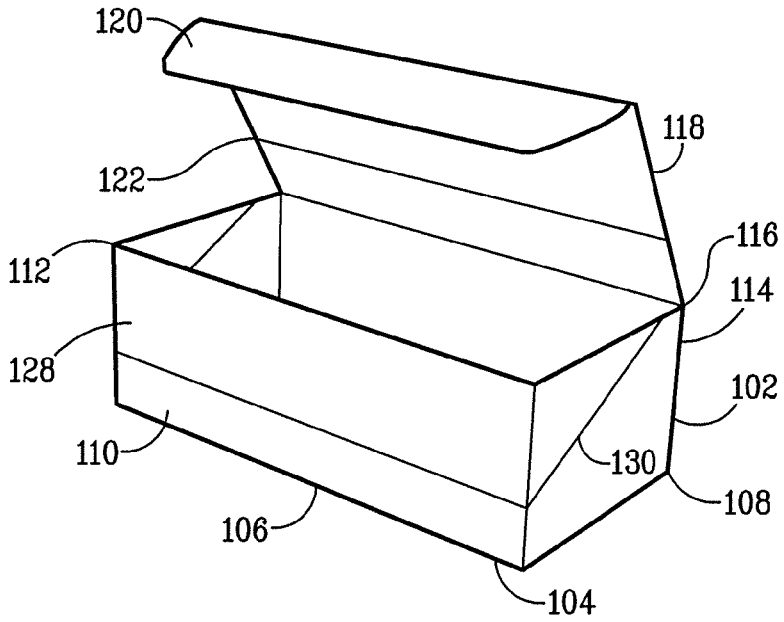
FIG. 4 presents a display carton configured for shipping a plurality of containers, in accordance herewith.
Figure 5:
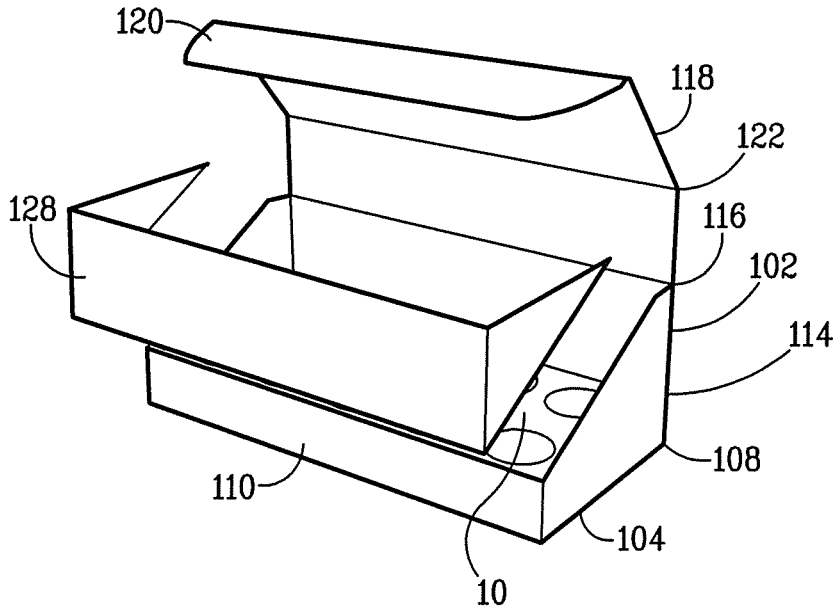
FIG. 5 presents a display carton being configured for displaying a plurality of containers, in accordance herewith.
Figure 6:
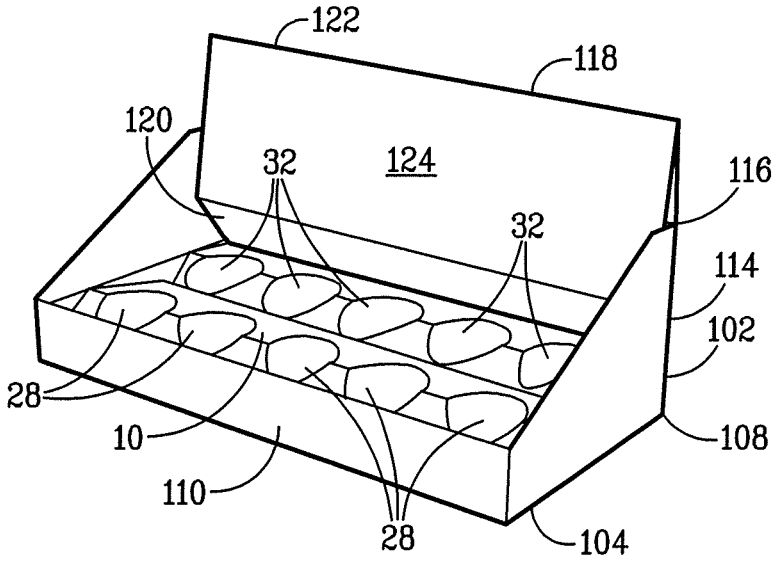
FIG. 6 presents a display carton configured for displaying a plurality of containers, in accordance herewith.

Reference will now be made to FIGS. 4-6 for further details regarding rectangular display carton 102. As shown, rectangular display carton 102 includes a base 104 having a front edge 106, and a back edge 108. Rectangular display carton 102 includes a front side member 110 extending perpendicularly from the front edge 106 of the base 104 and terminating at an upper edge 112, a rear side member 114 extending perpendicularly from the back edge 108 of the base 104 and terminating at an upper edge 116, the rear side member 114 having a cover panel 118 affixed to the rear side member 114. As shown, cover panel 118 is provided with a closure flap 120, which serves to securely close the rectangular display carton 102 for shipping. Cover panel 118 is also provided with fold line 122 for converting cover panel 118 into a point-of-sale display panel 124 (see FIG. 6).

Referring still to FIGS. 4-6, the method for converting the rectangular display carton 102 into a point-of-sale display will now be described. First, the rectangular display carton 102 is opened by lifting cover panel 118. Next removable panel 128 is separated at perforation 130 and removed. Finally, cover panel 118 is converted into the point-of-sale display panel 124 by folding along fold line 122 and tucking closure flap 120 behind display tray 10, as shown in FIG. 6.

In another aspect, provided is a method of presenting containers of product for sale to a consumer. The method includes the steps of arranging the containers in a display tray and protecting the containers with a carton for receiving the tray, the carton having a portion thereof structured and arranged to form a display panel, the display tray including a base having a first longitudinal edge, and a second longitudinal edge; a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section and having a plurality of openings positioned along an apex thereof; and configuring the portion of the carton so as to present a display panel while revealing the containers to the consumer.

Advantageously, the display cartons and trays disclosed herein are designed to be capable of high speed assembly, and employ the attendant machines and processes associated therewith.

As may be appreciated, the design of the display cartons and display trays disclosed herein allows for multiple quantities to be packaged. The forms contemplated include 8, 10, 12, 16, and 20 count packages.

All patents, test procedures, and other documents cited herein, including priority documents, are fully incorporated by reference to the extent such disclosure is not inconsistent with this disclosure and for all jurisdictions in which such incorporation is permitted.

While the illustrative embodiments disclosed herein have been described with particularity, it will be understood that various other modifications will be apparent to and can be readily made by those skilled in the art without departing from the spirit and scope of the disclosure.

Accordingly, it is not intended that the scope of the claims appended hereto be limited to the examples and descriptions set forth herein but rather that the claims be construed as encompassing all the features of patentable novelty which reside herein, including all features which would be treated as equivalents thereof by those skilled in the art to which the disclosure pertains.

What is claimed is:

1. A display tray for displaying a plurality of containers, comprising:

a) a base having a first longitudinal edge, and a second longitudinal edge;

b) a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and c) a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section and having a plurality of openings positioned along an apex thereof.

2. The display tray of claim 1, wherein the first tray member further comprises a third side extending from the lower edge of the second side and terminating at a downstream edge adjacent the first longitudinal edge of the base, wherein the edge formed by the second and third sides includes at least one locking tab extending therefrom.

3. The display tray of claim 2, wherein the second tray member further comprises a third side extending from the lower edge of the second side and terminating at a downstream edge adjacent the second longitudinal edge of the base, wherein the edge formed by the second and third sides includes at least one locking tab extending therefrom.

4. The display tray of claim 3, wherein the base further comprises a plurality of tab-receiving openings for receiving the at least one locking tab of the first tray member and the at least one locking tab of the second tray member.

5. The display tray of claim 1, wherein the base is rectangular.

6. The display tray of claim 5, wherein the apex of the first tray member and the apex of the second tray member are aligned in parallel.

7. The display tray of claim 1, wherein the plurality of openings of the first tray member and the plurality of openings of the second tray member are substantially circular.

8. The display tray of claim 3, wherein the downstream edge of the third side of the first tray member and the downstream edge of the third side of the second tray member each include a plurality of biasing scallops, the biasing scallops effective to bias the at least one locking tab of the first tray member and the at least one locking tab of the second tray member into locking engagement with the base.

9. The display tray of claim 1, wherein the display tray is formed from a sheet of cardboard stock.

10. The display tray of claim 1, wherein the display tray is formed from a sheet of substantially clear polyethylene terephthalate stock.

11. A system for displaying a plurality of containers at a point of sale, comprising:

a) display tray for displaying a plurality of containers, the display tray comprising i) a base having a first longitudinal edge, and a second longitudinal edge; ii) a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and iii) a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section and having a plurality of openings positioned along an apex thereof;

b) a rectangular carton for receiving the display tray; and c) a plurality of containers containing product, the plurality of containers configured for receipt by the plurality of openings of the first and second tray members of the display tray.

12. The system of claim 11, wherein the first tray member further comprises a third side extending from the lower edge of the second side and terminating at a downstream edge adjacent the first longitudinal edge of the base, wherein the edge formed by the second and third sides includes at least one locking tab extending therefrom.

13. The system of claim 12, wherein the second tray member further comprises a third side extending from the lower edge of the second side and terminating at a downstream edge adjacent the second longitudinal edge of the base, wherein the edge formed by the second and third sides includes at least one locking tab extending therefrom.

14. The system of claim 13, wherein the base further comprises a plurality of tab-receiving openings for receiving the at least one locking tab of the first tray member and the at least one locking tab of the second tray member.

15. The system of claim 11, wherein the base is rectangular.

16. The system of claim 15, wherein the apex of the first tray member and the apex of the second tray member are aligned in parallel.

17. The system of claim 11, wherein the plurality of openings of the first tray member and the plurality of openings of the second tray member are substantially circular.

18. The system of claim 13, wherein the downstream edge of the third side of the first tray member and the downstream edge of the third side of the second tray member each include a plurality of biasing scallops, the biasing scallops effective to bias the at least one locking tab of the first tray member and the at least one locking tab of the second tray member into locking engagement with the base.

19. The system of claim 11, wherein the display tray is formed from a sheet of cardboard stock.

20. The system of claim 11, wherein the display tray is formed from a sheet of substantially clear polyethylene terephthalate stock.

21. A method of forming a display tray for displaying a plurality of containers from a sheet of stock, the method comprising the steps of:

a) cutting the sheet of stock into a size and shape sufficient to form a substrate having a plurality of panels, the substrate having a first surface and a second surface and a first edge and a second edge, the first edge and the second edge of the substrate provided with a plurality of biasing scallops;

b) forming a plurality of openings lengthwise along the penultimate outer panels of the plurality of panels of the substrate;

c) forming a plurality of tab-receiving openings through the center panel of the plurality of panels of the substrate;

d) folding the outermost panels over to face the second surface of the substrate, each fold line of the outermost panels having at least one locking tab extending therefrom;

e) folding each of the penultimate outer panels of the plurality of panels of the substrate substantially along a longitudinal centerline thereof, so that the second surface of each portion of each penultimate outer panel faces the other;

f) positioning each outermost panel so that the plurality of biasing scallops of the first edge and the second edge extend through their respective adjacent plurality of openings;

g) positioning the at least one locking tab of each fold line of the outermost panels through the plurality of tab-receiving openings of the center panel; and h) positioning each of the outermost panels so as to contact the center panel;

wherein each of the plurality of biasing scallops contact a fold line formed by the center panel and each of the each penultimate outer panels so as to bias and lock each of the at least one locking tabs within its respective tab-receiving opening.

22. The method of claim 21, wherein the formed display tray includes a base having a first longitudinal edge, and a second longitudinal edge; a first tray member comprising a first side extending from the first longitudinal edge of the base and terminating at an upper edge thereof, a second side extending from the upper edge of the first side and terminating at a lower edge thereof adjacent the base; a third side extending from the lower edge of the second side and terminating at a downstream edge adjacent the first longitudinal edge of the base, wherein the edge formed by the second and third sides includes at least one locking tab extending therefrom, the first tray member forming a substantially triangular cross-section and having a plurality of openings positioned along an apex thereof; a second tray member comprising a first side extending from the second longitudinal edge of the base and terminating at an upper edge thereof, a second side extending from the upper edge of the first side and terminating at a lower edge thereof adjacent the base; a third side extending from the lower edge of the second side and terminating at a downstream edge adjacent the second longitudinal edge of the base, wherein the edge formed by the second and third sides includes at least one locking tab extending therefrom, the second tray member forming a substantially triangular cross-section and having a plurality of openings positioned along an apex thereof, wherein the base further comprises a plurality of tab-receiving openings for receiving the at least one locking tab of the first tray member and the at least one locking tab of the second tray member, wherein the downstream edge of the third side of the first tray member and the downstream edge of the third side of the second tray member each include a plurality of biasing scallops.

23. A method of presenting containers of product for sale to a consumer, the method comprising:

arranging the containers in a display tray and protecting the containers with a carton for receiving the tray, the carton having a portion thereof structured and arranged to form a display panel, the display tray comprising i) a base having a first longitudinal edge, and a second longitudinal edge; ii) a first tray member comprising a first side extending from the first longitudinal edge of the base and terminating at an upper edge thereof, a second side extending from the upper edge of the first side and terminating at a lower edge thereof adjacent the base, the first tray member forming a substantially triangular cross-section and having a plurality of openings positioned along an apex thereof; and iii) a second tray member comprising a first side extending from the second longitudinal edge of the base and terminating at an upper edge thereof, a second side extending from the upper edge of the first side and terminating at a lower edge thereof adjacent the base, the second tray member forming a substantially triangular cross-section and having a plurality of openings positioned along an apex thereof;

configuring the portion of the carton so as to present a display panel while revealing the containers to the consumer.

* * * * *